United States Patent [19]

Russell, Jr.

[11] 4,022,021

[45] May 10, 1977

[54] CONSTANT SPEED HYDRAULIC MOTOR

[76] Inventor: Wayne B. Russell, Jr., 3895 Lugo Ave., Lynwood, Calif. 90262

[22] Filed: Feb. 7, 1975

[21] Appl. No.: 547,809

[52] U.S. Cl. ..... 60/420; 60/456; 60/459; 60/468; 60/484

[51] Int. Cl.[2] ..... F15B 11/16; F15B 21/04

[58] Field of Search ..... 60/325, 456, 459, 468, 60/494, 420, 484

[56] References Cited

UNITED STATES PATENTS

| | | | |
|---|---|---|---|
| 2,102,865 | 12/1937 | Vickers | 60/462 |
| 2,329,709 | 9/1943 | Fischer | 60/DIG. 10 |
| 2,354,634 | 7/1944 | Griswold | 60/420 X |
| 2,665,704 | 1/1954 | Kanuch | 60/468 X |
| 3,210,939 | 10/1965 | Nuss | 60/468 |
| 3,248,913 | 5/1966 | Brundage | 60/468 X |
| 3,664,129 | 5/1972 | Schwab | 60/468 X |

*Primary Examiner*—Edgar W. Geoghegan

*Attorney, Agent, or Firm*—D. Gordon Angus; Donald D. Mon

[57] ABSTRACT

A hydraulic motor maintains its speed substantially constant in spite of changes of hydraulic fluid pressure and flow. The motor comprises a rotor to which hydraulic fluid is delivered through a nozzle arrangement from an inlet port and exhausted from the rotor to an exit port. A by-pass duct interconnects the passageway for the incoming fluid with the passageway for the outgoing fluid, to by-pass the rotor. A spring-loaded piston is situated in relation to the entrance to the by-pass duct so that when the incoming fluid pressure is relatively high the piston is retracted to expose the by-pass duct to permit some of the hydraulic fluid to by-pass the rotor, and when the fluid pressure and flow rate decrease, the spring moves the piston to close up the entrance to the by-pass duct to reduce or even stop the flow through the by-pass. A manual diverter valve is situated to divert incoming fluid away from the rotor so that all the fluid is diverted directly out of the motor housing.

5 Claims, 8 Drawing Figures

COOLER
FAN
P
M
V
rel
V
M
V
V

CONSTANT SPEED HYDRAULIC MOTOR

This invention relates to a hydraulic motor and system which maintains substantially constant motor speed in spite of changes of hydraulic fluid flow to the motor.

It is known to operate hydraulic components in a hydraulic system. Such a system ordinarily comprises a reservoir for hydraulic fluid and a pump driven by a source of power such as an internal combustion engine for driving the fluid through the system. The amount of load at the pump depends upon the hydraulic load in the system, which in turn depends on the type and number of components in operation. Hence, the load on the pump may vary from time to time. Such variations of load commonly have the effect of slowing the speed of the power source, for example an internal combustion engine. This in turn reduces the hydraulic flow through the system. It is sometimes important that a particular component in the system, for example a hydraulic motor, shall maintain a constant speed in spite of changes of hydraulic fluid flow into it. An instance where substantially constant speed is important is in the case of the motor driving a fan such as a cooling fan for cooling the hydraulic fluid in the system. Under situations where there is a heavy load on the pump the fluid tends to heat up more than in the case of a light load and it is undesirable for a cooling fan to slow down at times when it is most needed. There are many other instances where a motor capable of constant speed operation in spite of changing hydraulic fluid flow and pressure is desirable, for example for the driving of a conveyor or an electric generator or the like.

An object of the present invention is to provide a hydraulic motor which maintains its speed substantially constant even though the flow rate and pressure of the fluid driving it varies.

The invention is carried out by provision of a rotor driven by hydraulic fluid entering an inlet port and leaving through an exit port. A by-pass duct is provided for by-passing fluid around the rotor. Pressure operated means is related to the by-pass duct so that when the hydraulic fluid pressure at the inlet port increases, access to the by-pass duct is enhanced to by-pass more fluid around the rotor.

An optional feature resides in provision of means for diverting incoming fluid so that it is diverted from the motor.

The foregoing and other features of the invention will be better understood from the following detailed description and the accompanying drawings of which:

Figure 1:
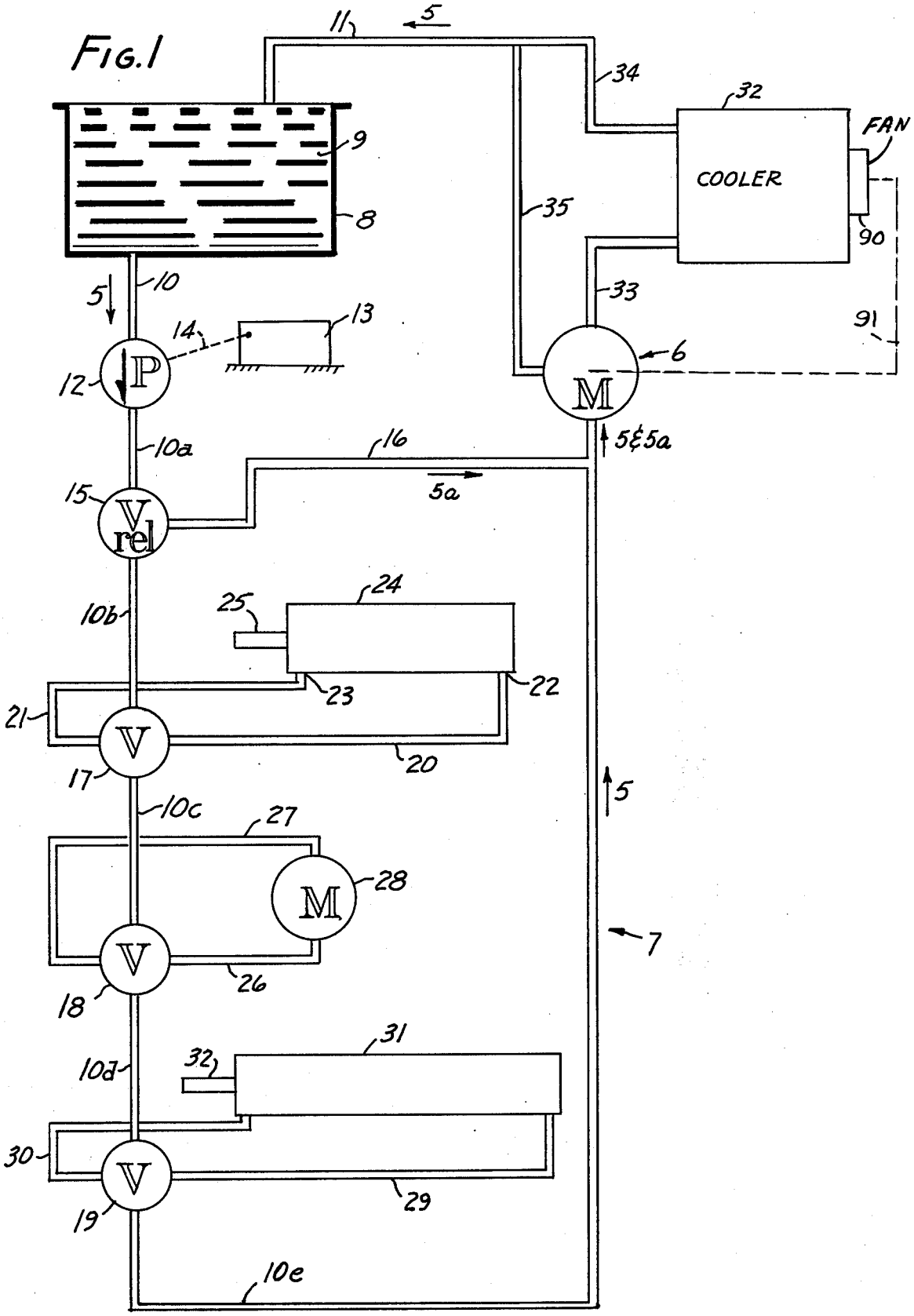
FIG. 1 shows a hydraulic system containing a motor according to this invention.
Figure 2:
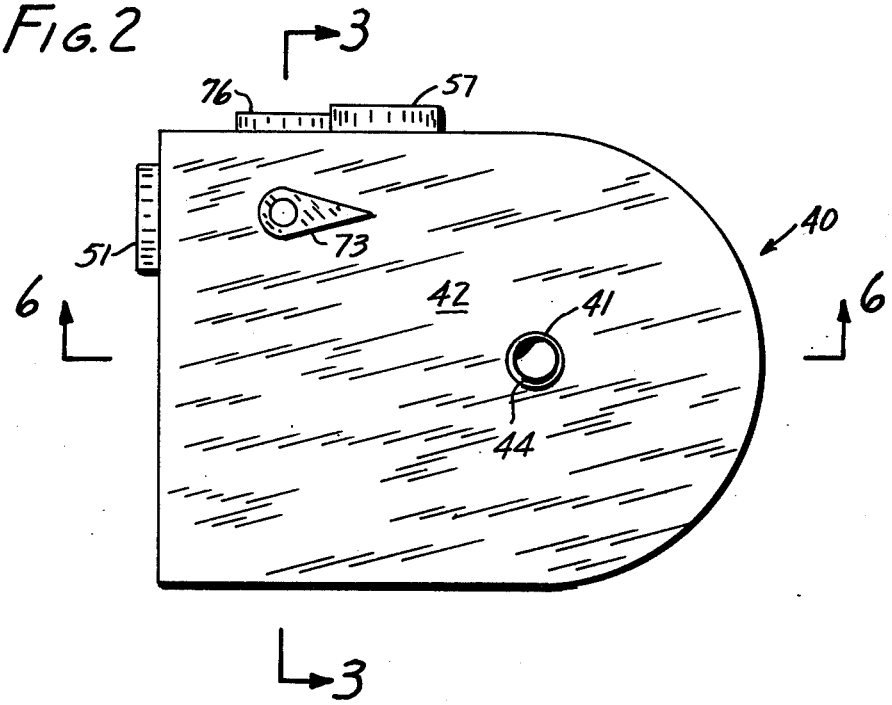
FIG. 2 is a top view looking from line 2—2 of FIG. 3, of a pressure controlled motor according to this invention.

In FIG. 1 there is shown a hydraulic system 7 containing a hydraulic motor 6 according to this invention. The hydraulic system has a reservoir 8 containing hydraulic fluid 9, ordinarily oil. The reservoir is enclosed except for an outlet conduit 10 and a return conduit 11. The outlet conduit 10 connects with a pump 12 driven by suitable means such as an engine, represented by rectangle 13, as indicated by dotted line 14. The engine may for example be of the internal combustion type. The high pressure side of the pump supplies a conduit section 10*a* leading to a relief valve 15 of a well-known type which operates in a well-known manner to bleed off fluid received from conduit section 10*a*, at the outlet from the pump, if the pressure at the relief valve exceeds a predetermined set value, in which event the fluid thus bled off is sent through a by-pass conduit 16 and into motor 6 to the return conduit 11 and back to the reservoir, thus keeping the pressure from the pump at or below the set pressure limit. Downstream from the relief valve 15 there are shown a number of devices operable from the pressurized hydraulic fluid. Thus, a conduit section 10*b* carries the pressurized fluid to valves 17, 18 and 19 arranged in tandem along the conduit sections 10*b*, 10*c*, and 10*d*, respectively, the last valve connecting with the inlet port of the hydraulic motor 6 through a conduit section 10*e*, flow from motor 6 being returned to the reservoir through conduit 11 in a manner to be described.

Valve 17 has connected to it, two conduits 20 and 21 which communicate with respective ports 22 and 23 at opposite sides of a hydraulic cylinder 24 which is of a well-known type having a rod or a member 25 protruding from it and connected with a piston (not shown) within the cylinder between the ports 22 and 23. The valve 17 is of a well-known type operable manually or by remote control to any of three positions. In a first position it puts the pressurized fluid from conduit 10*b* into conduit 20, but not into conduit 21, to move member 25 to the left (with reference to FIG. 1), and also receives and transmits to conduit section 10*c*, fluid forced out of the cylinder through conduit 21. In a second position it puts pressurized fluid from conduit 10*b* into conduit 21, but not into conduit 20, to move the member 25 to the right (with reference to FIG. 1), and at the same time receives and transfers fluid forced out through port 22 through conduit 20, into conduit section 10*c*. In the third position it puts pressurized fluid from conduit 10*b* into communication with conduit 10*c*, while blocking communication of both conduits 20 and 21 to either of conduits 10*b* and 10*c*.

The other valves 18 and 19 are similar to valve 17 and are connected with hydraulic conduits in the same manner as in the case of valve 17. Thus, valve 18 connects with respective conduits 26 and 27 leading to a fluid motor 28 so that the motor may be turned in either direction, or not at all, depending on which one of the three positions of valve 18 is selected. Similarly, valve 19 has connected to it conduits 29 and 30 which lead to ports at opposite ends of a cylinder 31 containing a piston actuated member 32, in a manner similar to the hydraulic arrangement associated with cylinder 24. Similarly, the member 32 of cylinder 31 may be operated in either direction, or not at all, depending upon the particular one of the three positions of valve 19 which is selected. Regardless of which positions the valves 17, 18 and 19 are put into, there will always be hydraulic fluid circulating in the direction of arrows 5 through conduit 10 and through all of these valves to conduit 11 and back to the reservoir, when ever the pump 12 is operated. In the event that relief valve 15 is operated by high fluid pressure, the relief flow 5*a* joins with flow 5, and both flows 5 and 5*a* pass into motor 6 and on to conduit 11, back to the reservoir. In the arrangement shown in FIG. 1 it is assumed, as an example, that the cylinders 24 and 31 and the motor 28, the reservoir 8 and the pump 11 are mounted with an engine, for example engine 13, for driving the pump, as equipment on a portable earth-drilling rig. Thus, the cylinder 24 and its ram 25 may be used in a well-known manner for leveling the rig; the shaft 32 of cylinder 31 may be provided with an earth-drilling auger in a well-known manner; and the motor 28 may be coupled with the shaft 32 to rotate the shaft relative to its cylinder for drilling purposes. Such equipment is well known in the drilling art. It should be understood that the cylinders and the motor 28 illustrated are shown simply as examples of typical equipment, and that more or less of such equipment, or different equipment, operated hydraulically, may be utilized in such a system.

The hydraulic motor 6 included in the system may be used for performance of such functions as may be desirable. For example, it is frequently desirable to provide means for cooling the hydraulic fluid which may become heated during operation of components such as components 24, 28 or 31, before passing the fluid back to the reservoir. Such a cooler is shown by the rectangle 32 in FIG. 1. Such a cooler is a well-known device and needs no detailed description here. In a common form it comprises pipes or conduits through which the fluid is passed, and a fan 90 for blowing air over the cooling pipes. In the use of such a cooler, the motor 6 may be used for operating the fan as indicated diagrammatically by the dotted line 91 to represent the drive. Fluid leaving the motor 6 flows through a conduit section 33 to the inlet of the cooler pipes and leaves the cooler through a conduit section 34 which carries the cooled fluid to conduit section 11 back to the reservoir. In the event it is desired to render the motor 6 inoperative while still pumping fluid through the system by pump 12, this may be done by diverting the fluid at the inlet side of the motor through a diverting conduit section 35 leading to return conduit 11, without passing the fluid through the motor.

It is seen that when the valves 17, 18 and 19 are all turned to the same position in which the hydraulic fluid flows directly through conduits 10*a*, 10*b*, 10*c*, 10*d*, 10*e* and 35 to the return conduit 11, the engine driving the pump need do only sufficient work on the pump to move the fluid in this path of travel, which will be opposed only by friction in the conduits and valves, assuming fluid is diverted through conduit 35 from motor 6. But when any one or more of valves 17, 18 and 19 is moved to a position in which work is being done at one or more of cylinders 24 and 31 and motor 28, the engine must work harder in order to do this work. Assuming the engine is of the internal combustion type having a throttle, and that the throttle is set at some particular position, the effect of the increased load at any one or more of components 24, 31 and 28 will slow down the engine, which will result in a corresponding decrease of rate of flow through pump 12 and a corresponding slowing of movement of cylinder members 25 and 32 and motor 28 and also of motor 6, assuming motor 6 to be of the usual hydraulic type. It is often desired that motor 6 shall not slow down even though the hydraulic fluid flow decreases, as for example, when the motor is to operate a cooling fan.

In accordance with the present invention, there is provided a hydraulic motor or turbine capable of maintaining constant speed in spite of changes of hydraulic fluid flow through it. Such a motor is illustrated in FIGS. 2 through 8.

The hydraulic motor of FIGS. 2 through 8 is contained in a block 40 of a hard rigid material, ordinarily metal. A central hole 41 is passed through the block from its top surface 42 to its bottom surface 43, which contains a rotor shaft 44 of a hydraulic motor. At a central location between the top and bottom surfaces 42 and 43 of the block, there is formed a cut-out defining a cavity 45 within the block, bounded by an outer cylindrical periphery 46 and upper and lower parallel surfaces 47 and 48 respectively, spaced apart from each other and located so that the longitudinal axis of the cylinder 46 coincides with the longitudinal axis of the hole 41 and the shaft 44. The dimensions of the cavity 45 are such that it contains the rotor or turbine 49 of the hydraulic motor fastened to the shaft 44. It is understood that the shaft 44 will be suitably supported by bearings such that proper clearance is maintained between the rotor and the walls of the cavity 45. The rotor is provided with blades or configurations 50 causing it to operate as a turbine. The particular configuration of the turbine and its blades needs no description here since forms of turbines are well-known and the particular form is no part of this invention.

For the purpose of operating the hydraulic motor, the block is provided with ports and passageways for hydraulic fluid flow, including fluid flow for driving the turbine. There is an inlet port 51 which communicates by a short passageway 51*a* with a cylindrical cavity 52 within the block. At the opposite side of the cavity 52 from the inlet port 51, the cavity communicates with a passageway 53, herein termed a fluid inlet passageway, the initial portion of which is aligned with the inlet 51. After extending from the cavity 52 for some distance the passageway 53 curls at 53*a* in a clockwise direction (with reference to FIG. 5) and narrows in cross-section to a relatively small cross-section at its end 53*b*. This curvature is approximately in the form of a half circle with its center at the axis of the turbine shaft 44.

Figure 7:
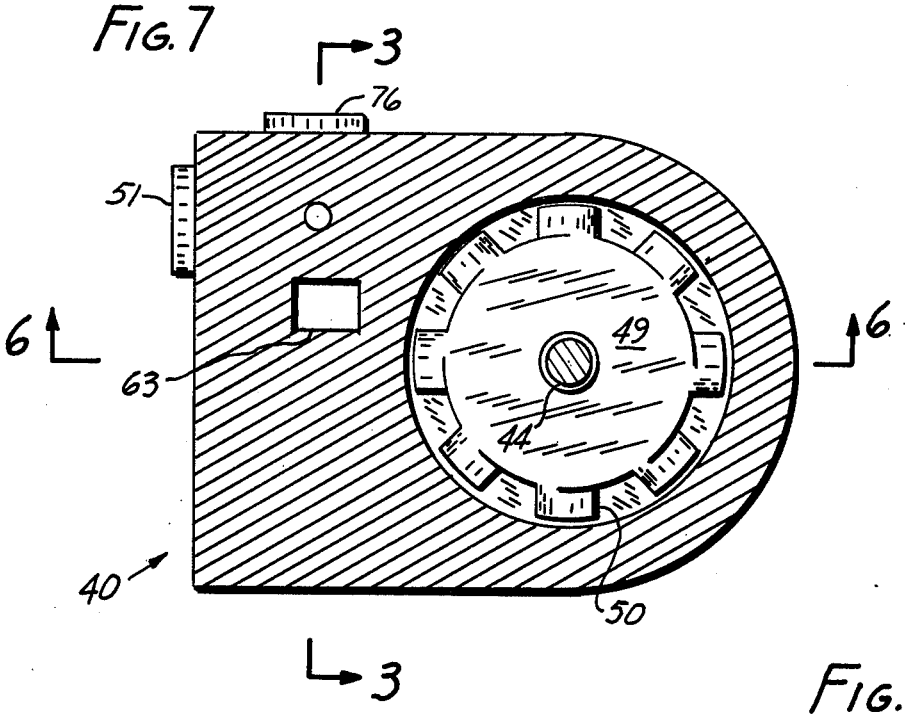
FIG. 7 is a cross-section view taken at line 7—7 of FIG. 6.

At a number of spaced positions around the curvature 53*a*, nozzles 54 in in communication with this passageway lead to the lower side of turbine cavity 45 (best seen in FIG. 6) so that pressurized fluid from the passageway 53 flows through the nozzles and impinges on the turbine blades 50 at the periphery of the turbine 49 to rotate the turbine in the clockwise direction, with reference to FIG. 7. At the upper side of the turbine cavity 45 at a position opposite the nozzles 54, there are a number of spaced exit passageways 55 which provide fluid communication from the turbine cavity to a curved portion 56*a* of a passageway 56, herein termed a fluid exit passageway, which is formed similar to the passageway 53, shown in FIG. 5. Thus, the curved portion 56*a* converges to smaller cross-sections to the end 56*b* of this passageway. The end of passageway 56 opposite its terminal end 56*b* communicates with a port 57. Thus, hydraulic fluid for driving the turbine can be sent into the inlet port 51 from where it will flow through the passageway 53 to the nozzles 54, through the turbine and out from the turbine cavity through passagways 55 and through passageway 56 to the outlet port 57.

The motor is provided with a fluid by-passing arrangement which can by-pass the turbine wheel depending on the fluid pressure. This comprises a passageway or bore 58 communicating with the cavity 52 to which the inlet port leads (seen in FIGS. 3 and 5) and extending to the opposite side of the block where the internal wall of the bore is threaded to receive an adjusting screw 59. A piston 60 is placed within the bore 58 with a helical compression spring 61 between it and the screw. The bore is provided with a shoulder 62 against which the forward side of the piston can abut.

Figure 4:
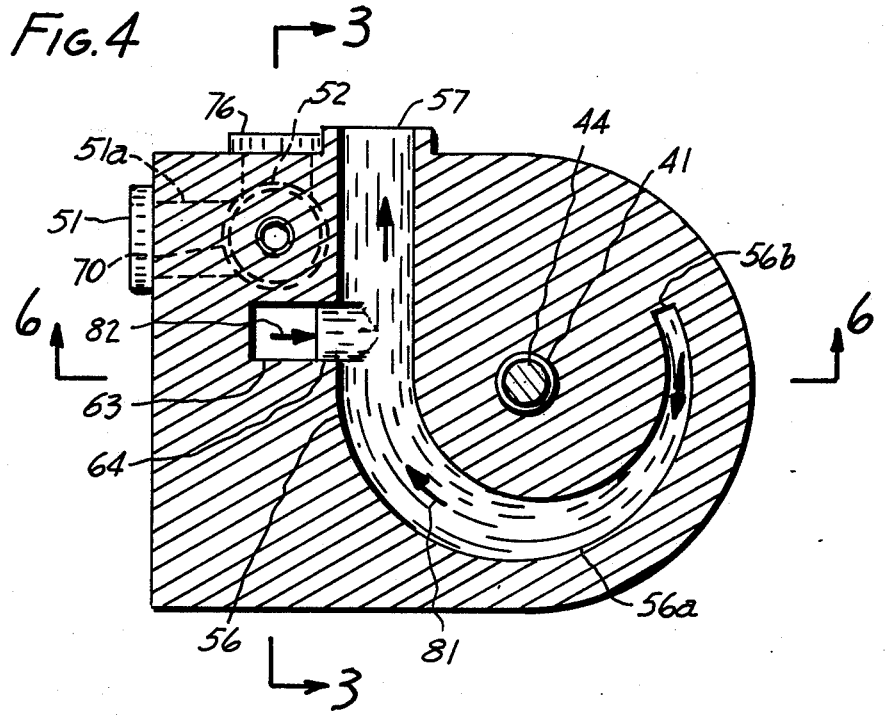
FIG. 4 is a cross-section view taken at line 4—4 of FIG. 3.
Figure 5:
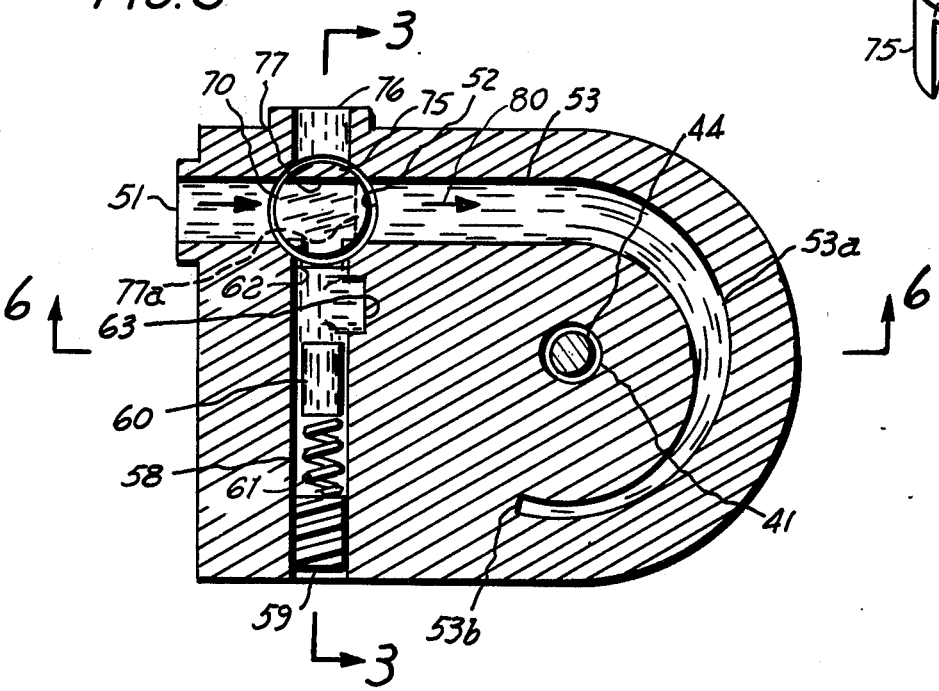
FIG. 5 is a cross-section view taken at line 5—5 of FIG. 3.

A duct 63 of square or rectangular cross-section interconnects the bore 58 with passageway 56. The lower end of the duct 63 joins the bore 58 at one side of the bore as best seen in FIG. 5. The upper end of duct 63 lies at one side of passageway 56 with which it communicates by a short duct 64 as seen in FIG. 4.

Figure 8:
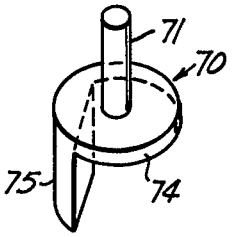
FIG. 8 is a perspective view of a fluid diverting valve incorporated into the motor.

Provision is made for diverting fluid from both the turbine and its by-pass. This diverting means comprises a spool 70 to which there is attached a stem 71 which passes upwardly through a bore 72 leading from the top of the cavity to the exterior of the block. This stem has a handle 73 outside the block, by which the stem may be manually rotated. As best seen in FIG. 8 the spool comprises a cylindrical disc-like member 74 having a depending shoe 75 in the shape of only part of a cylinder. At the same side of the block as that which contains port 57 there is provided a port 76 at the same level of the block as the inlet port 51. The port 76 extends to cavity 52 so that it can be put into communication with port 51, depending upon the position of shoe 75 of the spool 70. As seen in FIG. 5, shoe 75 has a cross-section in the form of a segment of the circle of the spool, of the proper dimensions so that when the spool is manually turned to the position of shoe 75, seen in FIGS. 3 and 5, the inside wall of the shoe conforms substantially with the corresponding wall of inlet port 51 and passageway 53 so that fluid entering port 51 can pass directly through the cavity 52 into passageway 53, and also can pass into passageway 58 and duct 63 provided the piston 60 is retracted from shoulder 62. When the stem 72 is turned 90° from the position shown in FIGS. 3 and 5, so that the inner wall 77 of the shoe takes the position shown by the dotted line 77*a* in FIG. 5, entrance of the hydraulic fluid into passageway 53 is blocked so that the turbine cannot rotate. Also, in normal practice, the piston 60 will assume its position in abutment with the shoulder 62 so that fluid will not pass into duct 63. The reason for this is that under this condition the shoe 77 is no longer blocking fluid flow from the cavity 52 out the port 76. Thus, fluid entering the inlet port 51 is diverted directly out through port 76 so that there is no significant pressure against the piston.

The operation of the system is as follows: Assume that the pump 12 is set into operation by the engine while all of valves 17, 18 and 19 are positioned to send the fluid directly from the pump through conduits 10*a*, 10*b*, 10*c*, 10*d*, 10*e*, back to the reservoir. The engine then will be delivering relatively little horsepower as there will be little back pressure against the pump. Under this condition there will be relatively little heating of the hydraulic fluid, because it is doing almost no work. Hence, it will probably be unnecessary to cool the fluid, and hence unnecessary to operate the motor 6 which drives the fan. For this purpose the stem 71 may be turned manually to the position in which the shoe 75 occupies the position shown by the dotted line 77*a* in FIG. 5, which will provide direct fluid communication from inlet port 51 to outlet port 76, and without permitting fluid to flow to the turbine. Furthermore, under this condition there will be relatively little pressure against the piston 60 which will contact shoulder 62 in passageway 58 so that the incoming fluid will not flow into duct 63.

If any of the components 24, 28 and 29 is set into operation by appropriate turning of any of the valves 17, 18 or 19, the back pressure against the pump will increase and the pump will exert a greater load on the engine, which will ordinarily slow the engine down. This will reduce the hydraulic fluid flow and will also heat up the fluid which is now performing some work. If an additional one or ones of the components 24, 28 and 31 be turned on, the engine would correspondingly slow down further and the hydraulic fluid would heat up still more.

The heating up of the fluid will often make it desirable to operate the cooler, although in cold weather cooling may not be necessary even when the system is performing work.

Figure 3:
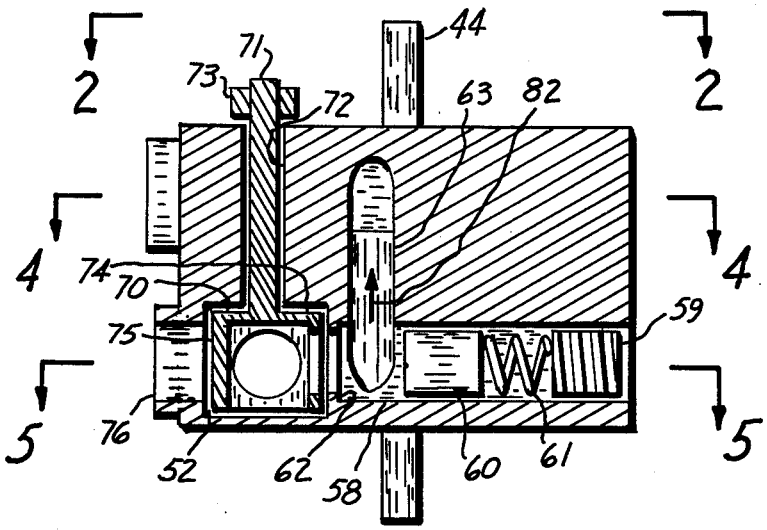
FIG. 3 is a cross-section view taken at line 3—3 of FIGS. 2, 4 and 7.
Figure 6:
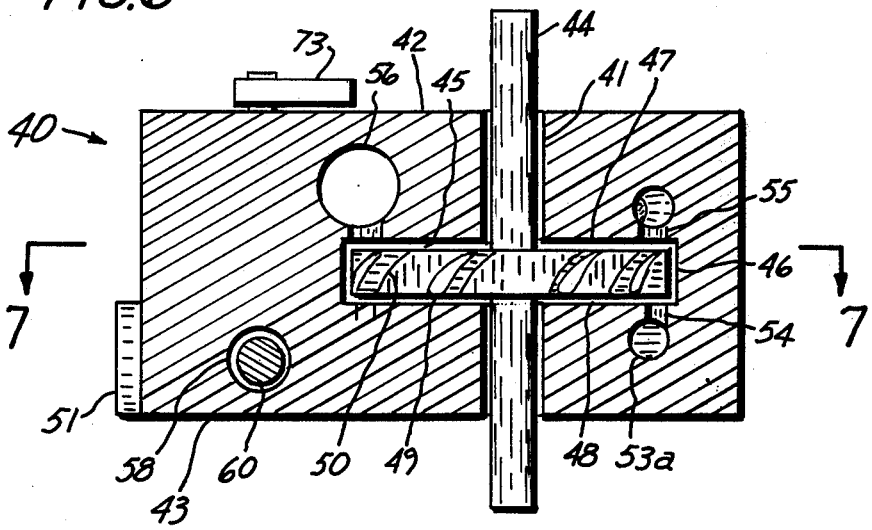
FIG. 6 is a cross-section view taken at line 6'6 of FIGS. 2, 4, 5 and 7.

In order to operate the cooler the operator will turn the stem 71 to its position shown in FIG. 3 where the shoe 75 is blocking the diverted fluid outlet 76, sending the fluid through fluid inlet passageway 53 as indicated by arrows 80 (FIG. 5) from where it enters the turbine cavity to rotate the turbine, and exits from the turbine cavity into fluid exit passageway 56 to the exit port 57 as indicated by arrows 81.

When the load on the pump and engine is relatively light, there is a relatively great rate of flow to the motor turbine 49 with a significant fluid pressure at the inlet port acting against piston 60. This pressure moves the piston to the right, (with reference to FIG. 3) so that some of the flow by-passes the turbine wheel through duct 63 as indicated by arrows 82 (as seen in FIGS. 3 and 4), to the fluid exit passageway 56 and out through exit port 57.

If now the load on the pump and engine increases, the fluid flow through the system is reduced so that there is a smaller flow rate and less pressure at the inlet port 51, which would tend to slow down the speed of the turbine except for the fact that the reduced pressure allows the piston 60 to be pushed by the spring 61 toward the shoulder 62 and thereby at least partially obstruct the entrance into duct 63 of by-passed fluid. This reduction of the flow through duct 63 causes more fluid flow through the turbine than would exist if the piston had not performed this function. As the fluid flow rate decreases still further by reason of increased load on the pump, the piston moves further toward the shoulder 62, thereby closing the entrance to the duct 63 still further, and may finally close the duct completely. The effect is to compensate for the decreased flow rate from the pump to the motor 6 so that in spite of changes of flow rate, the flow through the turbine and the speed of the turbine are maintained substantially constant. Accordingly, the normal flow of cooling air from a fan driven by the motor 6 is maintained even through the load, and hence the heating effect on the hydraulic fluid, is substantial.

It is seen that the action of the piston 60 can be adjusted by means of adjusting screw 59. It will generally be desired to adjust this so that the by-pass duct 82 will be completely closed off only under the condition of exceptionally low oil pressure. Furthermore, it will generally be desirable to design the hydraulic system so that the hydraulic fluid delivered to design the hydraulic system so that the hydraulic fluid delivered to the turbine is always maintained at least as much as that which is necessary to drive the turbine at its normal speed.

The manually operated diverter valve operated by lever 73 is usually a desirable component but is not essential to the operation of the turbine as a constant speed motor as just described. In the event of building a motor without the manually operated diverter valve, it would be only necessary to permanently close off the diverter exit port 76 by a wall positioned where the shoe 75 is located in FIG. 3, or simply eliminate the port 76 and have the area occupied by this port filled with solid wall of the block.

Although the hydraulic turbine 40 has been described as useful for driving a cooling fan, it will be understood that its use is not so limited. It is useful in any situation where a constant speed is desirable, for example to drive a conveyor or an electric generator.

As many of these hydraulic motors as desired can be used in the system, or anywhere in the system, and moreover such a motor could be used directly at the output of the pump if desired. Although the operation of the motor is effective at low fluid pressure it is also effective at high fluid pressure.

Although the hydraulic motor described herein is illustrated as a turbine type, it should be understood that the invention is not so limited, as some other type of rotor for the hydraulic motor may be used instead.

It will be understood that the embodiments of the invention illustrated and described herein, are given by way of illustration and not of limitation, and that modifications or equivalents or alternatives within the scope of the invention may suggest themselves to those skilled in the art.

I claim:

1. A constant speed hydraulic motor adapted for incorporation in a hydraulic system in series with a hydraulic pump and a variable hydraulic load, the load variations of which produce variations of fluid pressure and flow rate at the motor, said motor comprising a housing containing:

a. a fluid inlet port;
b. a fluid exit port;
c. a fluid driven rotor;
d. a fluid inlet passageway from the inlet port to the rotor;
e. a fluid exit passageway from the rotor to the exit port;
f. a by-pass duct adapted to provide fluid communication between the fluid inlet passageway and the fluid exit passageway, by-passing the rotor;
g. a cylinder in communication with the inlet port;
h. a piston in said cylinder movable in a path of travel which enables it to meter fluid flow into said duct, said piston being urged by fluid pressure at the inlet port to move toward a position where it does not greatly impede fluid flow into said duct; and
i. means urging said piston to move toward a position where it substantially blocks the fluid flow into said duct;

said motor including a cavity within which the rotor is contained, said fluid inlet passageway being located beneath said cavity and having a curved portion conforming substantially with the peripheral portion of the rotor, and nozzle means from said curved portion of the inlet passageway to the rotor cavity for injecting fluid to the rotor, said fluid exit passageway being located above said cavity and having a curved portion conforming substantially with the peripheral portion of the rotor, and passages from said cavity to said curved portion of the passageway for fluid flow from the cavity;

whereby when the fluid pressure and flow rate at the inlet port increases, the flow rate through said duct increases, and when the fluid pressure and flow rate at the inlet port decreases, the fluid flow rate through said duct decreases, thus maintaining the flow to the rotor and speed of the rotor substantially constant.

2. A motor according to claim 1 in which said means urging said piston to move comprises a spring including means for adjusting the pressure of said spring against said piston.

3. A motor according to claim 1 in which said housing comprises a block of rigid material and the duct extends through the block, one end of the duct being in communication with the cylinder and the other end of the duct being in communication with the fluid exit passageway.

4. A motor according to claim 1 in which said nozzle means comprises a plurality of nozzles spaced along the curved portion of the inlet passageway and positioned to direct fluid from the inlet passageway against spaced peripheral positions of the rotor, for driving the rotor, and said passages from the cavity to the exit passageway are spaced along the curved portion of the exit passageway.

5. A constant speed hydraulic motor having a rotor which continually rotates when supplied with a flow of hydraulic fluid, incorporated in a hydraulic system in series with a hydraulic pump, a fan-cooled cooler the fan of which is driven by the motor, and a variable hydraulic load, the load variations of which produce variations of fluid pressure and flow rate at the motor, said motor comprising a housing containing:

a. a fluid inlet port;
b. a fluid exit port;
c. a fluid driven rotor;
d. a fluid inlet passageway from the inlet port to the rotor;
e. a fluid exit passageway from the rotor to the exit port;
f. a by-pass duct adapted to provide fluid communication between the fluid inlet passageway and the fluid exit passageway, by-passing the rotor;
g. a cylinder in communication with the inlet port;
h. a piston in said cylinder movable in a path of travel which enables it to meter fluid flow into said duct, said piston being urged by fluid pressure at the inlet port to move toward a position where it does not greatly impede fluid flow into said duct; and
i. means urging said piston to move toward a position where it substantially blocks the fluid flow into said duct;

whereby when the fluid pressure and flow rate at the inlet port increases, the flow rate through said duct increases, and when the fluid pressure and flow rate at the inlet port decreases, the fluid flow rate through said duct decreases, thus maintaining the flow to the rotor and speed of the rotor substantially constant, and the fan maintains substantially constant speed regardless of changes of fluid flow rate and pressure at the motor, said motor being in a hydraulic system comprising a motor, a pump driven by power means whose speed decreases with increases of load on the pump, and hydraulic load means, in series arrangement in a hydraulic circuit, said load means imposing a load on the pump which is variable so that the fluid pressure and flow rate from the pump is also variable.

* * * * *